US008213827B2

(12) United States Patent
Shinshi et al.

(10) Patent No.: US 8,213,827 B2
(45) Date of Patent: Jul. 3, 2012

(54) FIXING DEVICE, IMAGE FORMING APPARATUS INCORPORATING SAME, AND FIXING METHOD

(75) Inventors: Akira Shinshi, Machida (JP); Kenichi Hasegawa, Atsugi (JP); Hiroshi Yoshinaga, Ichikawa (JP); Yoshiki Yamaguchi, Sagamihara (JP); Yutaka Ikebuchi, Chigasaki (JP); Ippei Fujimoto, Ebina (JP); Shuntaroh Tamaki, Kawasaki (JP); Toshihiko Shimokawa, Zama (JP); Naoki Iwaya, Choufu (JP)

(73) Assignee: Ricoh Company, Ltd., Tokyo (JP)

( * ) Notice: Subject to any disclaimer, the term of this patent is extended or adjusted under 35 U.S.C. 154(b) by 160 days.

(21) Appl. No.: 12/852,079

(22) Filed: Aug. 6, 2010

(65) Prior Publication Data

US 2011/0052245 A1 Mar. 3, 2011

(30) Foreign Application Priority Data

Sep. 1, 2009 (JP) ..... 2009-201196

(51) Int. Cl.
*G03G 21/20* (2006.01)
*G03G 15/20* (2006.01)

(52) U.S. Cl. ..... 399/92; 399/324; 399/333

(58) Field of Classification Search ..... 399/92, 399/320, 324, 325, 328, 330, 333
See application file for complete search history.

(56) References Cited

U.S. PATENT DOCUMENTS

| | | | |
|---|---|---|---|
| 6,131,009 | A | 10/2000 | Hasegawa |
| 6,496,666 | B2 | 12/2002 | Hayashi et al. |
| 6,591,081 | B2 | 7/2003 | Hasegawa |
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,881,927 | B2 | 4/2005 | Yoshinaga et al. |
| 6,882,820 | B2 | 4/2005 | Shinshi et al. |
| 6,892,044 | B2 | 5/2005 | Yasui et al. |
| 7,022,944 | B2 | 4/2006 | Yoshinaga et al. |
| 7,070,182 | B2 | 7/2006 | Hasegawa |

(Continued)

FOREIGN PATENT DOCUMENTS

JP 9-230733 9/1997

(Continued)

OTHER PUBLICATIONS

Extended European Search Report issued Sep. 2, 2011, in Patent Application No. 10173953.0.

*Primary Examiner* — Hoang Ngo
(74) *Attorney, Agent, or Firm* — Oblon, Spivak, McClelland, Maier & Neustadt, L.L.P.

(57) ABSTRACT

In a fixing device, a metal member is provided inside a fixing belt to heat the fixing belt. A first lubricant is applied between the metal member and the fixing belt at a center portion of the fixing belt in an axial direction of the fixing belt that contacts a recording medium bearing a toner image. A second lubricant having a viscosity greater than a viscosity of the first lubricant is applied between the metal member and the fixing belt at lateral edge portions of the fixing belt in the axial direction of the fixing belt that do not contact the recording medium.

9 Claims, 6 Drawing Sheets

U.S. PATENT DOCUMENTS

| | | | | |
|---|---|---|---|---|
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,330,682 | B2 | 2/2008 | Shinshi | |
| 7,379,698 | B2 | 5/2008 | Yoshinaga | |
| 7,437,111 | B2 | 10/2008 | Yamada et al. | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,515,850 | B2 | 4/2009 | Hasegawa | |
| 7,546,049 | B2 | 6/2009 | Ehara et al. | |
| 7,561,841 | B2 * | 7/2009 | Callis et al. | 399/327 |
| 7,593,680 | B2 | 9/2009 | Shinshi | |
| 7,630,652 | B2 | 12/2009 | Hasegawa | |
| 7,702,271 | B2 | 4/2010 | Yamada et al. | |
| 7,742,714 | B2 | 6/2010 | Shinshi et al. | |
| 7,805,102 | B2 * | 9/2010 | Kato | 399/329 |
| 2006/0029411 | A1 | 2/2006 | Ishii et al. | |
| 2006/0257183 | A1 | 11/2006 | Ehara et al. | |
| 2007/0003334 | A1 | 1/2007 | Shinshi et al. | |
| 2007/0014600 | A1 | 1/2007 | Ishii et al. | |
| 2007/0059071 | A1 | 3/2007 | Shinshi et al. | |
| 2007/0292175 | A1 | 12/2007 | Shinshi | |
| 2008/0063443 | A1 | 3/2008 | Yoshinaga et al. | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0253788 | A1 | 10/2008 | Shinshi | |
| 2008/0253789 | A1 | 10/2008 | Yoshinaga et al. | |
| 2008/0298862 | A1 | 12/2008 | Shinshi | |
| 2008/0317532 | A1 | 12/2008 | Ehara et al. | |
| 2009/0003867 | A1 | 1/2009 | Fujimoto | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0169232 | A1 | 7/2009 | Kunii et al. | |
| 2009/0245865 | A1 | 10/2009 | Shinshi et al. | |
| 2009/0311016 | A1 | 12/2009 | Shinshi | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |

FOREIGN PATENT DOCUMENTS

| | | |
|---|---|---|
| JP | 2884714 | 2/1999 |
| JP | 2002-323819 | 11/2002 |
| JP | 2008-32903 | 2/2008 |
| JP | 2008-58378 | 3/2008 |
| JP | 2008-158482 | 7/2008 |
| JP | 2009-3410 | 1/2009 |

* cited by examiner

FIXING DEVICE, IMAGE FORMING APPARATUS INCORPORATING SAME, AND FIXING METHOD

CROSS-REFERENCE TO RELATED APPLICATIONS

The present application is based on and claims priority to Japanese Patent Application No. 2009-201196, filed on Sep. 1, 2009, in the Japan Patent Office, which is hereby incorporated herein by reference in its entirety.

BACKGROUND OF THE INVENTION

1. Field of the Invention

Exemplary aspects of the present invention relate to a fixing device, an image forming apparatus, and a fixing method, and more particularly, to a fixing device for fixing a toner image on a recording medium, an image forming apparatus including the fixing device, and a fixing method for fixing a toner image on a recording medium.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a cylindrical-shaped metal member to heat the fixing device effectively to shorten a warm-up time or a time to first print (hereinafter also "first print time"). Specifically, the metal member provided inside a loop formed by an endless fixing belt and facing the inner circumferential surface of the fixing belt is heated by an internal heater so as to heat the fixing belt. A pressing roller presses against the outer circumferential surface of the fixing belt to form a nip between the fixing belt and the pressing roller over which the recording medium bearing the toner image passes. As the recording medium bearing the toner image passes through the nip, the fixing belt and the pressing roller apply heat and pressure to the recording medium to fix the toner image on the recording medium.

While the fixing belt rotates in accordance with rotation of the pressing roller, the fixing belt slides over the stationary metal member, generating friction between the fixing belt and the metal member and resulting in wear of the fixing belt. To address this problem, a lubricant may be applied between the fixing belt and the metal member. However, the lubricant is heated by the metal member and volatilized. Thereafter, the lubricant is leaked from a gap between lateral edges of the fixing belt and the metal member. Accordingly, the lubricant is reduced over time, and therefore is not provided between the fixing belt and the metal member in an amount sufficient to prevent wear of the fixing belt sliding over the metal member.

BRIEF SUMMARY OF THE INVENTION

This specification describes below an improved fixing device. In one exemplary embodiment of the present invention, the fixing device fixes a toner image on a recording medium and includes a flexible endless fixing belt, a metal member, a rotary pressing member, a first lubricant, and a second lubricant. The fixing belt rotates in a predetermined direction of rotation and includes a center portion in an axial direction of the fixing belt that contacts the recording medium bearing the toner image and lateral edge portions in the axial direction of the fixing belt adjacent to the center portion that do not contact the recording medium bearing the toner image. The metal member is provided inside a loop formed by the fixing belt and faces an inner circumferential surface of the fixing belt to heat the fixing belt. The rotary pressing member contacts an outer circumferential surface of the fixing belt to form a nip between the rotary pressing member and the fixing belt that nips and conveys the recording medium bearing the toner image. The first lubricant is applied between the metal member and the inner circumferential surface of the fixing belt at the center portion of the fixing belt. The second lubricant having a viscosity greater than a viscosity of the first lubricant is applied between the metal member and the inner circumferential surface of the fixing belt at the lateral edge portions of the fixing belt.

This specification further describes an image forming apparatus. In one exemplary embodiment, the image forming apparatus includes the fixing device described above.

This specification further describes a fixing method. In one exemplary embodiment, the fixing method fixes a toner image on a recording medium and includes the steps of rotating a flexible endless fixing belt in a predetermined direction of rotation, transmitting heat from a metal member provided inside a loop formed by the fixing belt and facing an inner circumferential surface of the fixing belt to the fixing belt, and rotatively pressing a rotary pressing member against the fixing belt to form a nip between the rotary pressing member and the fixing belt that nips and conveys the recording medium bearing the toner image. The fixing method further includes the steps of applying a first lubricant between the metal member and the inner circumferential surface of the fixing belt at a center portion of the fixing belt in an axial direction of the fixing belt over which the recording medium bearing the toner image passes, and applying a second lubricant, of which viscosity is greater than a viscosity of the first lubricant, between the metal member and the inner circumferential surface of the fixing belt at lateral edge portions of the fixing belt in the axial direction of the fixing belt over which the recording medium bearing the toner image does not pass.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
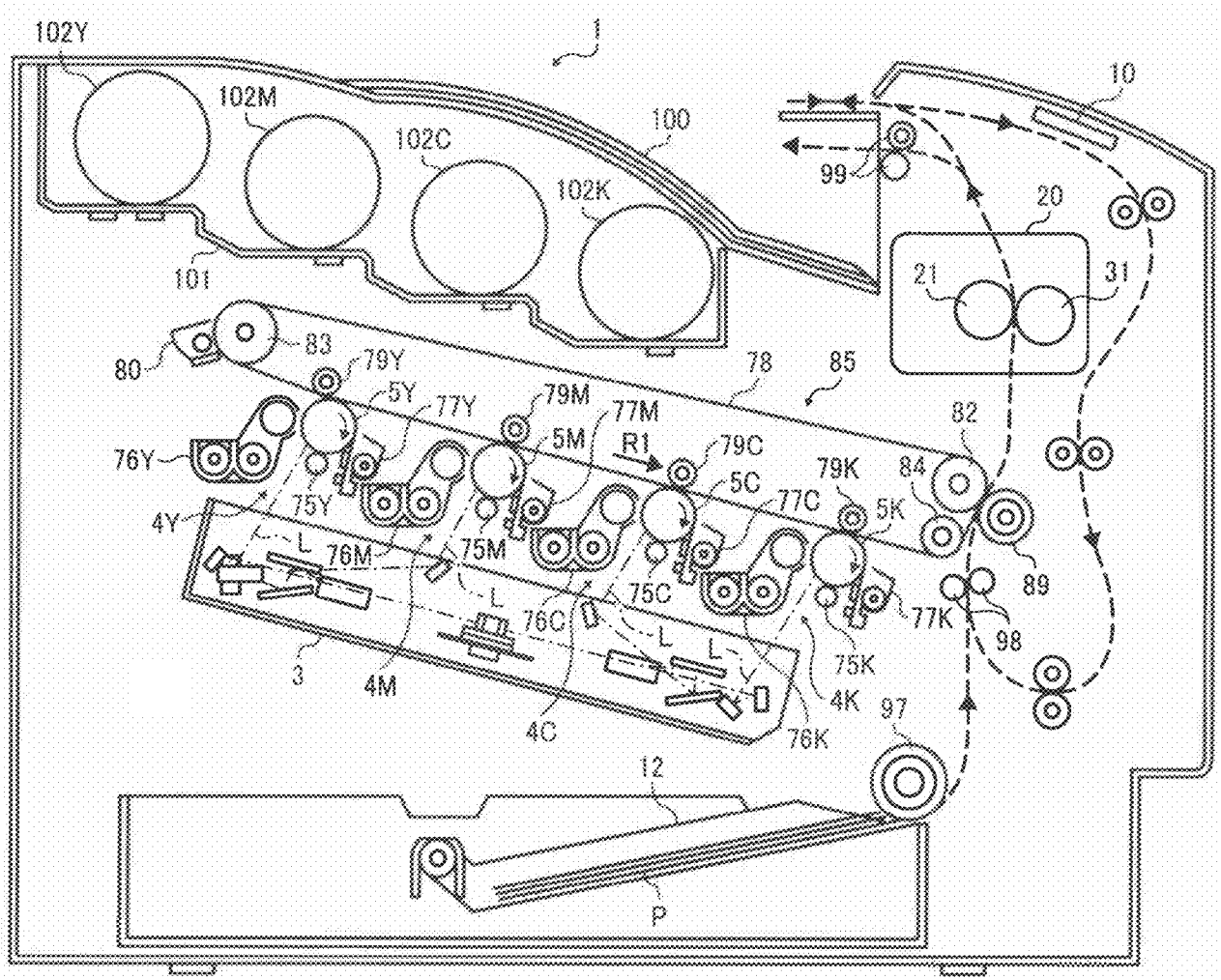
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 1, the image forming apparatus 1 includes an exposure device 3, image forming devices 4Y, 4M, 4C, and 4K, a controller 10, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The paper tray 12 is provided in a lower portion of the image forming apparatus 1, and loads a plurality of recording media P (e.g., transfer sheets). The feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip.

At the second transfer nip, the second transfer roller 89 and the second transfer backup roller 82 sandwich the intermediate transfer belt 78. The second transfer roller 89 transfers the color toner image formed on the intermediate transfer belt 78 onto the recording medium P fed by the registration roller pair 98 at the second transfer nip formed between the second transfer roller 89 and the intermediate transfer belt 78. Thus, the desired color toner image is formed on the recording medium P. After the transfer of the color toner image, residual toner, which has not been transferred onto the recording medium P, remains on the intermediate transfer belt 78.

The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

The controller 10 controls operation of the components of the image forming apparatus 1.

Referring to FIGS. 2 to 5, the following describes the structure and operation of the fixing device 20.

Figure 2:
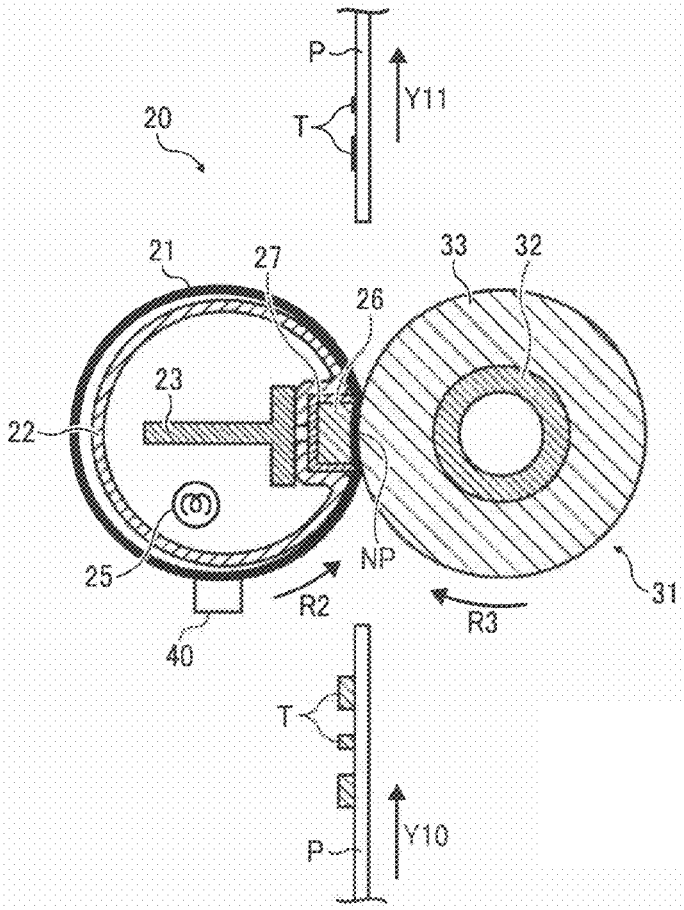
FIG. 2 is a sectional view of a fixing device included in the image forming apparatus shown in FIG. 1.

FIG. 2 is a sectional view of the fixing device 20. As illustrated in FIG. 2, the fixing device 20 further includes a metal member 22, a reinforcement member 23, a heater 25, a stationary member 26, a heat insulator 27, and a temperature sensor 40. The pressing roller 31 includes a metal core 32 and an elastic layer 33.

Figure 3:
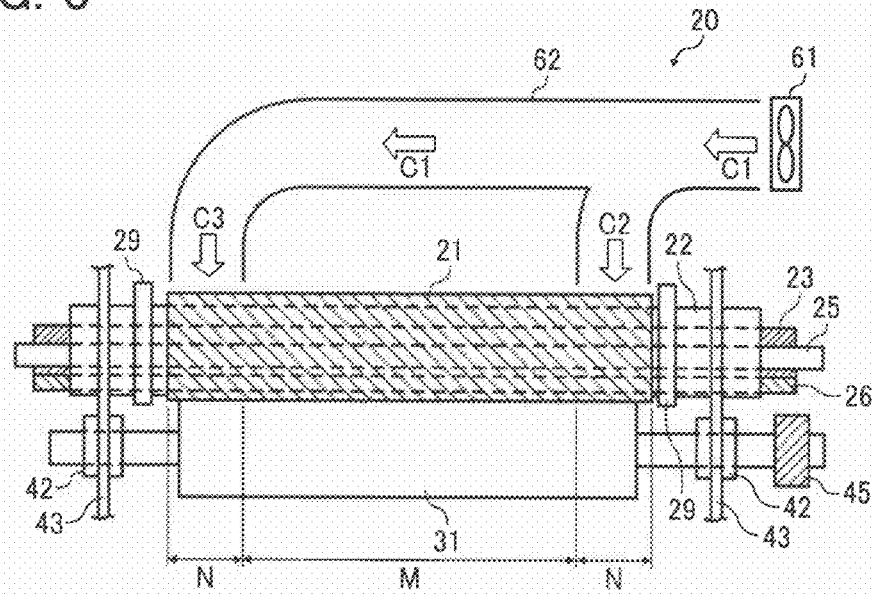
FIG. 3 is a plan view of the fixing device shown in FIG. 2.

FIG. 3 is a plan view of the fixing device 20. As illustrated in FIG. 3, the fixing device 20 further includes flanges 29, bearings 42, side plates 43, a gear 45, a cooling fan 61, and a duct 62.

Figure 4:
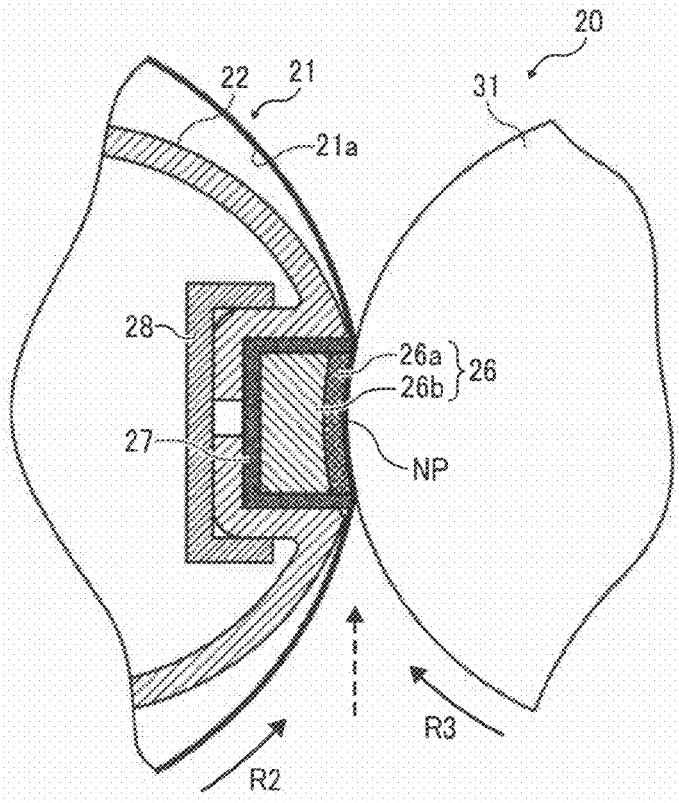
FIG. 4 is a partially enlarged sectional view of the fixing device shown in FIG. 2.

FIG. 4 is a partially enlarged sectional view of the fixing device 20. As illustrated in FIG. 4, the fixing device 20 further includes a stay 28. The fixing belt 21 includes an inner circumferential surface 21*a*. The stationary member 26 includes a surface layer 26*a* and a base layer 26*b*.

Figure 5:
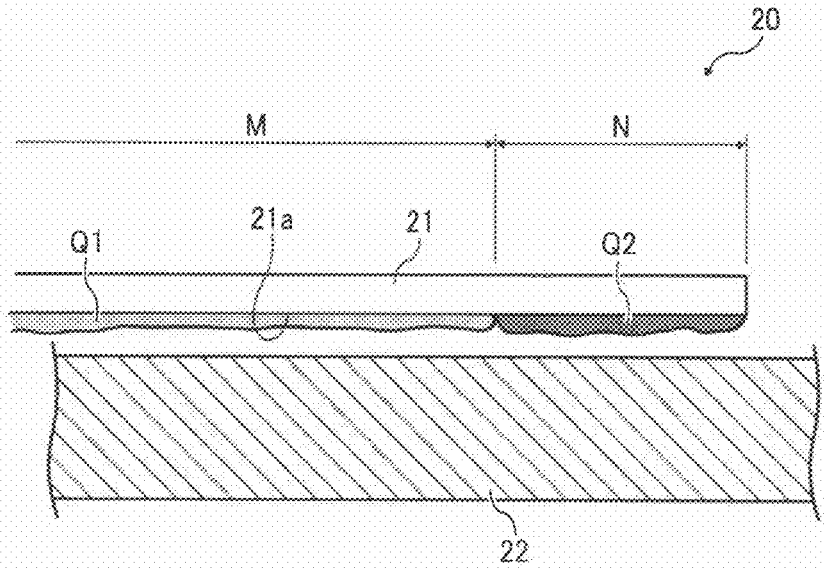
FIG. 5 is a partially enlarged sectional view of a fixing belt and a metal member included in the fixing device shown in FIG. 4.

FIG. 5 is a partially enlarged sectional view of the fixing belt 21 and the metal member 22.

As illustrated in FIGS. 2 and 4, the fixing device 20 includes the fixing belt 21 serving as a fixing member or a belt member, the stationary member 26, the metal member 22 serving as a heating member, the reinforcement member 23, the heat insulator 27, the heater 25 serving as a heater or a heat source, the pressing roller 31 serving as a rotary pressing member, the temperature sensor 40, and the stay 28.

The fixing belt 21 serving as a fixing member may be a thin, flexible endless belt that rotates or moves counterclockwise in FIG. 2 in a rotation direction R2. The fixing belt 21 is constructed of a base layer, an intermediate elastic layer, and a surface release layer, and has a total thickness not greater than about 1 mm. The base layer includes the inner circumferential surface 21*a* serving as a sliding surface which slides over the stationary member 26. The elastic layer is provided on the base layer. The release layer is provided on the elastic layer.

The base layer of the fixing belt 21 has a thickness in a range of from about 30 μm to about 50 μm, and includes a metal material such as nickel and/or stainless steel, and/or a resin material such as polyimide.

The elastic layer of the fixing belt 21 has a thickness in a range of from about 100 μm to about 300 μm, and includes a rubber material such as silicon rubber, silicon rubber foam, and/or fluorocarbon rubber. The elastic layer eliminates or reduces slight surface asperities of the fixing belt 21 at a nip NP formed between the fixing belt 21 and the pressing roller 31. Accordingly, heat is uniformly transmitted from the fixing belt 21 to a toner image T on a recording medium P, suppressing formation of a rough image such as an orange peel image.

The release layer of the fixing belt 21 has a thickness in a range of from about 10 μm to about 50 μm, and includes tetrafluoroethylene-perfluoroalkylvinylether copolymer (PFA), polytetrafluoroethylene (PTFE), polyimide, polyetherimide, and/or polyether sulfide (PES). The release layer releases or separates the toner image T from the fixing belt 21.

The fixing belt 21 has a loop diameter in a range of from about 15 mm to about 120 mm. According to this exemplary embodiment, the fixing belt 21 has an inner diameter of about 30 mm. As illustrated in FIGS. 2 and 4, the stationary member 26, the heater 25, the metal member 22, the reinforcement member 23, the heat insulator 27, and the stay 28 are fixedly provided inside a loop formed by the fixing belt 21. In other words, the stationary member 26, the heater 25, the metal member 22, the reinforcement member 23, the heat insulator 27, and the stay 28 do not face an outer circumferential surface of the fixing belt 21, but face the inner circumferential surface 21*a* of the fixing belt 21.

The stationary member 26 is fixed inside the fixing belt 21 in such a manner that the inner circumferential surface 21*a* of the fixing belt 21 slides over the stationary member 26. The stationary member 26 presses against the pressing roller 31 via the fixing belt 21 to form the nip NP between the fixing belt 21 and the pressing roller 31 through which the recording medium P is conveyed. As illustrated in FIG. 3, both ends of the stationary member 26 in a width direction of the stationary member 26 parallel to an axial direction of the fixing belt 21 are mounted on and supported by the side plates 43 of the fixing device 20, respectively.

As illustrated in FIG. 2, the metal member 22 has a substantially cylindrical shape. The metal member 22 serving as a heating member directly faces the inner circumferential surface 21*a* of the fixing belt 21 at a position other than the nip NP. At the nip NP, the metal member 22 holds the stationary member 26 via the heat insulator 27. As illustrated in FIG. 3, both ends of the metal member 22 in a width direction of the metal member 22 parallel to the axial direction of the fixing belt 21 are mounted on and supported by the side plates 43 of the fixing device 20, respectively. The flanges 29 are provided on both ends of the metal member 22 in the width direction of the metal member 22 to restrict movement (e.g., shifting) of the fixing belt 21 in the axial direction of the fixing belt 21.

The metal member 22 heated by radiation heat generated by the heater 25 heats (e.g., transmits heat to) the fixing belt 21. In other words, the heater 25 heats the metal member 22 directly and heats the fixing belt 21 indirectly via the metal member 22. The metal member 22 may have a thickness not greater than about 0.1 mm to maintain desired heating efficiency for heating the fixing belt 21.

The metal member 22 may include a metal thermal conductor, that is, a metal having thermal conductivity, such as stainless steel, nickel, aluminum, and/or iron. Preferably, the metal member 22 may include ferrite stainless steel having a relatively smaller heat capacity per unit volume obtained by multiplying density by specific heat. According to this exemplary embodiment, the metal member 22 includes SUS430 stainless steel as ferrite stainless steel, and has a thickness of 0.1 mm.

The heater 25, serving as a heater or a heat source, may be a halogen heater and/or a carbon heater. As illustrated in FIG. 3, both ends of the heater 25 in a width direction of the heater 25 parallel to the axial direction of the fixing belt 21 are fixedly mounted on the side plates 43 of the fixing device 20, respectively. Radiation heat generated by the heater 25, which is controlled by a power source provided in the image forming apparatus 1 depicted in FIG. 1, heats the metal member 22. The metal member 22 heats substantially the entire fixing belt 21. In other words, the metal member 22 heats a portion of the fixing belt 21 other than the nip NP. Heat is transmitted from the heated outer circumferential surface of the fixing belt 21 to the toner image T on the recording medium P.

As illustrated in FIG. 2, the temperature sensor 40, which may be a thermistor, faces the outer circumferential surface of the fixing belt 21 to detect a temperature of the outer circumferential surface of the fixing belt 21. The controller 10 depicted in FIG. 1 controls the heater 25 according to detection results provided by the temperature sensor 40 so as to adjust the temperature (e.g., a fixing temperature) of the fixing belt 21 to a desired temperature.

As described above, in the fixing device 20 according to this exemplary embodiment, the metal member 22 does not heat a small part of the fixing belt 21 but heats substantially the entire fixing belt 21 in a circumferential direction of the fixing belt 21. Accordingly, even when the image forming apparatus 1 depicted in FIG. 1 forms a toner image at high speed, the fixing belt 21 is heated enough to suppress fixing failure. In other words, the relatively simple structure of the fixing device 20 heats the fixing belt 21 efficiently, resulting in a shortened warm-up time, a shortened first print time, and the downsized image forming apparatus 1.

The metal member 22 is disposed opposite the fixing belt 21 in such a manner that a certain clearance A is provided between the inner circumferential surface 21*a* of the fixing belt 21 and the metal member 22 all along the inner surface of the fixing belt 21 except for where the nip NP is formed. The clearance A, that is, a gap between the fixing belt 21 and the metal member 22 at all points along the inner surface of the fixing belt 21 other than the nip NP, is not greater than 1 mm, expressed as $0\ \text{mm} < A \leqq 1\ \text{mm}$. Accordingly, the fixing belt 21 does not slidably contact the metal member 22 over an increased area, thus suppressing wear of the fixing belt 21. At the same time, the clearance provided between the metal member 22 and the fixing belt 21 is small enough to prevent any substantial decrease in heating efficiency of the metal member 22 for heating the fixing belt 21. Moreover, the metal member 22 disposed close to the fixing belt 21 supports the fixing belt 21 and maintains the circular loop form of the flexible fixing belt 21, thus limiting degradation of and damage to the fixing belt 21 due to deformation of the fixing belt 21.

A lubricant, such as fluorine grease, is applied between the inner circumferential surface 21*a* of the fixing belt 21 and the metal member 22, so as to decrease wear of the fixing belt 21 as the fixing belt 21 slidably contacts the metal member 22.

According to this exemplary embodiment, the metal member 22 has a substantially circular shape in cross-section. Alternatively, the metal member 22 may have a polygonal shape in cross-section or may include a slit along a circumferential surface thereof.

As illustrated in FIG. 2, the reinforcement member 23 reinforces the stationary member 26 which forms the nip NP between the fixing belt 21 and the pressing roller 31. The reinforcement member 23 is fixedly provided inside the loop formed by the fixing belt 21 and faces the inner circumferential surface 21*a* of the fixing belt 21.

As illustrated in FIG. 3, a width of the reinforcement member 23 in a width direction of the reinforcement member 23 parallel to the axial direction of the fixing belt 21, is equivalent to a width of the stationary member 26 in the width direction of the stationary member 26 parallel to the axial direction of the fixing belt 21. Both ends of the reinforcement member 23 in the width direction of the reinforcement member 23 are fixedly mounted on the side plates 43 of the fixing device 20, respectively, in such a manner that the side plates 43 support the reinforcement member 23. As illustrated in FIG. 2, the reinforcement member 23 is pressed against the pressing roller 31 via the stationary member 26 and the fixing belt 21. Thus, the stationary member 26 is not deformed substantially when the stationary member 26 receives pressure applied by the pressing roller 31 at the nip NP.

In order to provide the above-described functions, the reinforcement member 23 may include a metal material having great mechanical strength, such as stainless steel and/or iron. An opposing surface of the reinforcement member 23 which faces the heater 25 may include a heat insulation material partially or wholly. Alternatively, the opposing surface of the reinforcement member 23 disposed opposite the heater 25 may be mirror-ground. Accordingly, heat output by the heater 25 toward the reinforcement member 23 to heat the reinforcement member 23 is used to heat the metal member 22, improving heating efficiency for heating the metal member 22 and the fixing belt 21.

As illustrated in FIG. 2, the pressing roller 31 serves as a rotary pressing member for contacting and pressing against the outer circumferential surface of the fixing belt 21 at the nip NP. The pressing roller 31 has a loop diameter of about 30 mm. In the pressing roller 31, the elastic layer 33 is provided on the hollow metal core 32. The elastic layer 33 may be silicon rubber foam, silicon rubber, and/or fluorocarbon rubber. A thin release layer including PFA and/or PTFE may be provided on the elastic layer 33 to serve as a surface layer. The pressing roller 31 is pressed against the fixing belt 21 to form the desired nip NP between the pressing roller 31 and the fixing belt 21.

As illustrated in FIG. 3, the gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31, are rotatively supported by the side plates 43 of the fixing device 20 via the bearings 42, respectively. A heat source, such as a halogen heater, may be provided inside the pressing roller 31, but is not necessary.

When the elastic layer 33 of the pressing roller 31 includes a sponge material such as silicon rubber foam, the pressing roller 31 applies decreased pressure to the fixing belt 21 at the nip NP to decrease bending of the metal member 22. Further, the pressing roller 31 provides increased heat insulation, and therefore heat is not transmitted from the fixing belt 21 to the pressing roller 31 easily, improving heating efficiency for heating the fixing belt 21.

According to this exemplary embodiment, the loop diameter of the fixing belt 21 is equivalent to the loop diameter of the pressing roller 31. Alternatively, the loop diameter of the fixing belt 21 may be smaller than the loop diameter of the pressing roller 31. In this case, a curvature of the fixing belt 21 is smaller than a curvature of the pressing roller 31 at the nip NP, and therefore a recording medium P separates from the fixing belt 21 easily when the recording medium P is discharged from the nip NP.

As illustrated in FIG. 4, the inner circumferential surface 21*a* of the fixing belt 21 slides over the stationary member 26. In the stationary member 26, the surface layer 26*a* is provided on the base layer 26*b* and constitutes an opposing surface portion (e.g., a sliding surface portion) of the stationary member 26, which faces the pressing roller 31 and has a concave shape corresponding to the curvature of the pressing roller 31. The recording medium P moves along the concave, opposing surface portion of the stationary member 26 corresponding to the curvature of the pressing roller 31, and is discharged from the nip NP. The concave shape facilitates separation of the recording medium P bearing the fixed toner image T from the fixing belt 21.

According to this exemplary embodiment, the stationary member 26 has a concave shape to form the concave nip NP. Alternatively, the stationary member 26 may have a flat, planar shape to form a planer nip NP. Specifically, the sliding surface portion of the stationary member 26 which faces the pressing roller 31 may have a flat, planar shape. Accordingly, the planar nip NP formed by the planar sliding surface portion of the stationary member 26 is substantially parallel to an image side of the recording medium P. Consequently, the fixing belt 21 pressed by the planar sliding surface portion of the stationary member 26 is adhered to the recording medium P precisely to improve fixing property. Further, the increased curvature of the fixing belt 21 at an exit of the nip NP facilitates separation of the recording medium P discharged from the nip NP from the fixing belt 21.

The base layer 26*b* of the stationary member 26 includes a rigid material (e.g., a highly rigid metal or ceramic) so that the stationary member 26 is not bent substantially by pressure applied by the pressing roller 31.

The substantially pipe-shaped metal member 22 may be formed by bending sheet metal into the desired shape. Sheet metal is used to give the metal member 22 a thin thickness to shorten warm-up time. However, such a thin metal member 22 has little rigidity, and therefore is easily bent or deformed by pressure applied by the pressing roller 31. A deformed metal member 22 does not provide a desired nip length of the nip NP, degrading fixing property. To address this problem, according to this exemplary embodiment, the rigid stationary member 26 is provided separately from the thin metal member 22 to help form and maintain the proper nip NP.

As illustrated in FIG. 4, the heat insulator 27 is provided between the stationary member 26 and the heater 25. Specifically, the heat insulator 27 is provided between the stationary member 26 and the metal member 22 in such a manner that the heat insulator 27 covers surfaces of the stationary member 26 other than the sliding surface portion of the stationary member 26 over which the fixing belt 21 slides. The heat insulator 27 includes sponge rubber having desired heat insulation and/or ceramic including air pockets.

The metal member 22 is disposed close to the fixing belt 21 throughout substantially the entire circumference thereof. Accordingly, even in a standby mode before printing starts, the metal member 22 heats the fixing belt 21 in the circumferential direction without temperature fluctuation. Consequently, the image forming apparatus 1 starts printing as soon as the image forming apparatus 1 receives a print request. In conventional on-demand fixing devices, when heat is applied to the deformed pressing roller 31 at the nip NP in the standby mode, the pressing roller 31 may suffer from thermal degradation due to heating of the rubber included in the pressing roller 31, resulting in a shortened life of the pressing roller 31 or permanent compression strain of the pressing roller 31. Heat applied to the deformed rubber increases permanent compression strain of the rubber. The permanent compression strain of the pressing roller 31 makes a dent in a part of the pressing roller 31, and therefore the pressing roller 31 does not provide the desired nip length of the nip NP, generating faulting fixing or noise in accordance with rotation of the pressing roller 31.

To address those problems, according to this exemplary embodiment, the heat insulator 27 is provided between the stationary member 26 and the metal member 22 to reduce heat transmitted from the metal member 22 to the stationary member 26 in the standby mode, suppressing heating of the deformed pressing roller 31 at high temperature in the standby mode.

A lubricant is applied between the stationary member 26 and the fixing belt 21 to reduce sliding resistance between the stationary member 26 and the fixing belt 21. However, the lubricant may deteriorate under high pressure and temperature applied at the nip NP, resulting in unstable slippage of the fixing belt 21 over the stationary member 26. To address this problem, according to this exemplary embodiment, the heat insulator 27 is provided between the stationary member 26 and the metal member 22 to reduce heat transmitted from the metal member 22 to the lubricant at the nip NP, thus reducing deterioration of the lubricant due to high temperature.

The heat insulator 27 provided between the stationary member 26 and the metal member 22 insulates the stationary member 26 from the metal member 22. Accordingly, the metal member 22 heats the fixing belt 21 with reduced heat at the nip NP. Consequently, the recording medium P discharged from the nip NP has a decreased temperature compared to when the recording medium P enters the nip NP. In other words, at the exit of the nip NP, the fixed toner image T on the recording medium P has a decreased temperature, and therefore the toner of the fixed toner image T has a decreased viscosity. Accordingly, an adhesive force which adheres the fixed toner image T to the fixing belt 21 is decreased and the recording medium P is separated from the fixing belt 21. Consequently, the recording medium P is not wound around the fixing belt 21 immediately after the fixing process, preventing or reducing jamming of the recording medium P and adhesion of the toner of the toner image T to the fixing belt 21.

As illustrated in FIG. 4, the stay 28 contacts an inner circumferential surface opposite an outer circumferential surface facing the heat insulator 27, of a concave portion of the metal member 22 into which the stationary member 26 is inserted so as to hold the metal member 22.

In the present embodiment, a stainless steel sheet having a thickness of about 0.1 mm is bent into the substantially pipe-shaped metal member 22. However, spring-back of the stainless steel sheet may expand a circumference of the metal member 22, and therefore the stainless steel sheet may not maintain the desired pipe shape. As a result, the metal member 22 having an expanded circumference may contact the inner circumferential surface of the fixing belt 21, damaging the fixing belt 21 or generating temperature fluctuation of the fixing belt 21 due to uneven contact of the metal member 22 to the fixing belt 21.

To address this problem, according to this exemplary embodiment, the stay 28 supports and holds the concave portion (e.g., a bent portion) of the metal member 22 provided with an opening so as to prevent deformation of the metal member 22 due to spring-back. For example, the stay 28 is press-fitted to the concave portion of the metal member 22 to contact the inner circumferential surface of the metal member 22 while the shape of the metal member 22 that is bent against spring-back of the stainless steel sheet is maintained.

Preferably, the metal member 22 has a thickness not greater than about 0.2 mm to increase heating efficiency of the metal member 22.

As described above, the metal sheet is bent into the substantially pipe-shaped, thin metal member 22 to shorten warm-up time, but lacks the rigidity to withstand deformation due to pressure from the pressing roller 31 and therefore is bent or deformed. Accordingly, the deformed metal member 22 may not provide a desired nip length of the nip NP, resulting in degraded fixing property. To address this problem, according to this exemplary embodiment, the concave portion of the thin metal member 22 into which the stationary member 26 is inserted is spaced away from the nip NP to prevent the metal member 22 from receiving pressure from the pressing roller 31 directly.

Referring to FIGS. 1 and 2, the following describes operation of the fixing device 20 having the above-described structure. When the image forming apparatus 1 is powered on, power is supplied to the heater 25, and the pressing roller 31 starts rotating in the rotation direction R3. Friction between the pressing roller 31 and the fixing belt 21 rotates the fixing belt 21 in the rotation direction R2.

Thereafter, a recording medium P is sent from the paper tray 12 to the second transfer nip formed between the intermediate transfer belt 78 and the second transfer roller 89. At the second transfer nip, a color toner image is transferred from the intermediate transfer belt 78 onto the recording medium P. A guide plate guides the recording medium P bearing the toner image T in a direction Y10 so that the recording medium P enters the nip NP formed between the fixing belt 21 and the pressing roller 31 pressed against each other.

At the nip NP, the fixing belt 21 heated by the heater 25 via the metal member 22 applies heat to the recording medium P. Simultaneously, the pressing roller 31 and the stationary member 26 reinforced by the reinforcement member 23 apply pressure to the recording medium P. Thus, the heat applied by the fixing belt 21 and the pressure applied by the pressing roller 31 fix the toner image T on the recording medium P. Thereafter, the recording medium P bearing the fixed toner image T discharged from the nip NP is conveyed in a direction Y11.

The following describes the structure and operation of the fixing device 20 in detail.

As illustrated in FIG. 3, the cooling fan 61 serves as a cooling unit for cooling non-conveyance regions N provided at lateral edge portions of the fixing belt 21 in the width direction of the fixing belt 21, that is, the axial direction of the fixing belt 21, over which the recording medium P does not pass. The cooling fan 61 sends air to the non-conveyance regions N to cool the non-conveyance regions N provided at the lateral edge portions of the fixing belt 21 in the width direction of the fixing belt 21. Specifically, air sent by the cooling fan 61 is guided by the bifurcated duct 62 in directions C1, C2, and C3 toward the non-conveyance regions N provided at the lateral edge portions of the fixing belt 21 to cool the non-conveyance regions N. According to this exemplary embodiment, a width of each of the non-conveyance regions N in the width direction, that is, the axial direction of the fixing belt 21, is about 20 mm.

As illustrated in FIG. 5, a lubricant Q1 serving as a first lubricant is applied between the fixing belt 21 and the metal member 22 at a center portion of the fixing belt 21 in the width direction of the fixing belt 21. A lubricant Q2 serving as a second lubricant is applied between the fixing belt 21 and the metal member 22 at the lateral edge portions of the fixing belt 21 in the width direction of the fixing belt 21. For example, the lubricant Q1 is applied on the inner circumferential surface 21*a* of the fixing belt 21 in a conveyance region M through which the recording medium P passes. The lubricant Q2 is applied on the inner circumferential surface 21*a* of the fixing belt 21 in the non-conveyance regions N through which the recording medium P does not pass. A viscosity of the lubricant Q2 is greater than a viscosity of the lubricant Q1. In other words, the lubricant Q1 is a low-viscosity lubricant having a relatively low viscosity. By contrast, the lubricant Q2 is a high-viscosity lubricant having a relatively high viscosity.

For example, the lubricant Q1 applied on the fixing belt 21 in the conveyance region M may be fluorine grease having a kinematic viscosity of 180 centistokes (cSt) at 40 degrees centigrade. The lubricant Q2 applied on the fixing belt 21 in the non-conveyance regions N may be high-viscosity grease having a kinematic viscosity of 400 cSt at 40 degrees centigrade.

The above-described arrangement provides a relatively small sliding torque of the fixing belt 21 sliding over the metal member 22, prevents leakage of the lubricant Q1 and the lubricant Q2 applied between the fixing belt 21 and the metal member 22 from one end of the fixing belt 21 in the width direction of the fixing belt 21 due to volatilization by heat, and reduces wear of the fixing belt 21 sliding over the metal member 22 over time stably.

Figure 6:
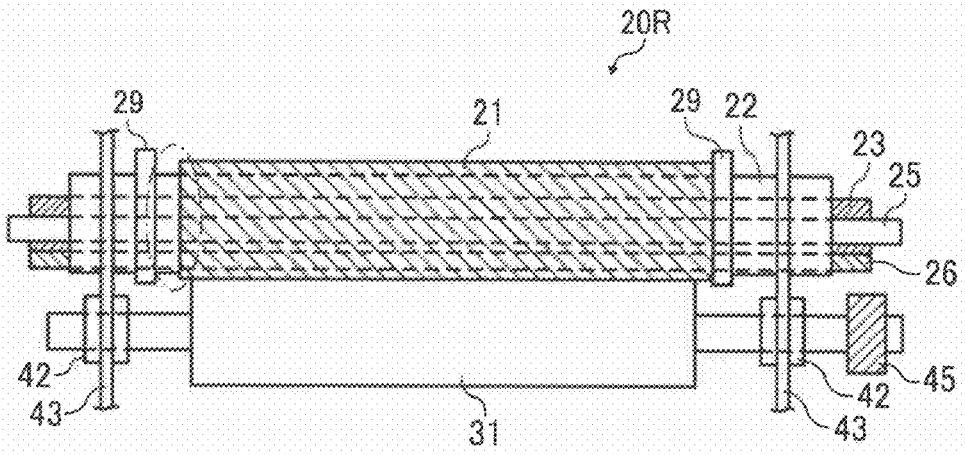
FIG. 6 is a plan view of a comparative fixing device.

To further illustrate the advantages of the present embodiment, FIG. 6 is a schematic plan view of a comparative fixing device 20R. As illustrated in FIG. 6, the comparative fixing device 20R includes the elements described above, other than the two different lubricants and the cooling fan 61 and the duct 62 depicted in FIG. 3. In the comparative fixing device 20R, a lubricant applied between the fixing belt 21 and the metal member 22 may leak from one end, which is indicated by alternate long and short dashed lines, of the fixing belt 21 in the width direction of the fixing belt 21 after volatilization by heat. The leakage of the lubricant causes a shortage of or exhausts the lubricant applied between the fixing belt 21 and the metal member 22 over time. In the end, the fixing belt 21 slides over the metal member 22 directly, wearing the fixing belt 21 and the metal member 22.

A slight clearance is provided between the fixing belt 21 and the metal member 22. The substantially pipe-shaped metal member 22 forms a closed space in cross-section. Accordingly, the lubricant hardly leaks into an inside of the metal member 22. By contrast, one end, that is, a right end in FIG. 6, of the fixing belt 21 in the width direction of the fixing belt 21 contacts the right flange 29, and a gap appears easily between the left flange 29 and at least another end, that is, a left end indicated by alternate long and short dashed lines in FIG. 6, of the fixing belt 21 in the width direction of the fixing belt 21. Accordingly, the volatilized lubricant leaks out from the gap between the left flange 29 and the left end of the fixing belt 21. Moreover, the rotating fixing belt 21 slides over the metal member 22 that does not rotate. Therefore, it is difficult to seal the left end of the fixing belt 21 with respect to the metal member 22 completely.

To address this problem of the comparative device, the fixing device 20 according to this exemplary embodiment reduces leakage of the lubricant from the left end of the fixing belt 21 by cooling the lubricant and therefore suppressing volatilization of the lubricant. This is accomplished by making a width of the metal member 22 and a width of the fixing belt 21 in the width direction of the fixing belt 21 sufficiently greater than a width of a maximum size recording medium P which the image forming apparatus 1 is capable of accommodating. For example, the non-conveyance regions N, each of which has a width of about 20 mm, are provided adjacent to the conveyance region M in the width direction of the fixing belt 21 in such a manner that the non-conveyance regions N sandwich the conveyance region M. The cooling fan 61 depicted in FIG. 3 cools the non-conveyance regions N. Thus, the cooling fan 61 suppresses temperature increase of the lubricant applied in the non-conveyance regions N, and therefore suppresses volatilization of the lubricant. As a result, the lubricant does not leak from the left end of the fixing belt 21 easily.

If the cooling fan 61 cools the conveyance region M of the fixing belt 21, the cooled fixing belt 21 may have degraded ability to heat and melt the toner image T on the recording medium P. For this reason, the cooling fan 61 is designed so that it cools only the non-conveyance regions N of the fixing belt 21.

Further, the thin fixing belt 21 and the thin metal member 22 provide a relatively smaller amount of heat transfer in the width direction, that is, the axial direction, of the fixing belt 21. Accordingly, even when the cooling fan 61 cools the non-conveyance regions N of the fixing belt 21, heat is not transferred from the conveyance region M to the non-conveyance regions N, and therefore heating efficiency of the fixing belt 21 and the metal member 22 does not deteriorate in the conveyance region M.

The high-viscosity lubricant Q2 is not volatilized by heat easily, but increases sliding torque of the fixing belt 21 sliding over the metal member 22. By contrast, the low-viscosity lubricant Q1 decreases sliding torque of the fixing belt 21 sliding over the metal member 22, but is volatilized by heat easily. Accordingly, if the high-viscosity lubricant Q2 is applied on the inner circumferential surface 21*a* of the fixing belt 21 throughout the entire width direction of the fixing belt 21, the cooling fan 61 prevents leakage of the high-viscosity lubricant Q2 from the left end of the fixing belt 21 sufficiently. However, the high-viscosity lubricant Q2 increases overall driving torque of the fixing device 20, resulting in shortened life of the gear 45 depicted in FIG. 3, an upsized driving motor for driving the fixing device 20, and increased manufacturing costs of the fixing device 20.

Therefore, according to this exemplary embodiment, the high-viscosity lubricant Q2 is applied only to the lateral edge portions of the fixing belt 21 in the width direction of the fixing belt 21, that is, the non-conveyance regions N, to increase the cooling effect. By contrast, the low-viscosity lubricant Q1 is applied to other regions, that is, the conveyance region M. Accordingly, leakage of the lubricant Q2 from the left end of the fixing belt 21 due to volatilization of the lubricant Q2 is decreased precisely without increasing driving torque of the fixing device 20 excessively. The cooling fan 61 suppresses volatilization of the high-viscosity lubricant Q2 applied to the lateral edge portions of the fixing belt 21 in the width direction of the fixing belt 21 to maintain viscosity of the high-viscosity lubricant Q2. Thus, the high-viscosity lubricant Q2 also serves as a stopper for suppressing flowing of the low-viscosity lubricant Q1 having fluidity increased by heat at the center portion of the fixing belt 21 in the width direction of the fixing belt 21.

As described above, in the fixing device 20 according to this exemplary embodiment, the low-viscosity lubricant Q1 is applied between the fixing belt 21 and the metal member 22 in the conveyance region M corresponding to the center portion of the fixing belt 21 in the width direction of the fixing belt 21 over which the recording medium P passes. The high-viscosity lubricant Q2 is applied between the fixing belt 21 and the metal member 22 in the non-conveyance regions N corresponding to the lateral edge portions of the fixing belt 21 in the width direction of the fixing belt 21 over which the recording medium P does pass. The cooling fan 61 cools the non-conveyance regions N provided at the lateral edge portions of the fixing belt 21 in the width direction of the fixing belt 21. Accordingly, even when the fixing device 20 is driven at high speed with a shortened warm-up time and a shortened first print time, the fixing device 20 does not generate faulty fixing, does not increase sliding torque of the fixing belt 21 sliding over the metal member 22, and stably reduces wear of the fixing belt 21 and the metal member 22 generating over time due to sliding of the fixing belt 21 over the metal member 22.

According to this exemplary embodiment, the fixing belt 21 having the multi-layer structure is used as a fixing belt. Alternatively, an endless fixing film including polyimide, polyamide, fluorocarbon resin, and/or metal may be used as a fixing belt to provide effects equivalent to the effects provided by the fixing device 20.

Figure 7:
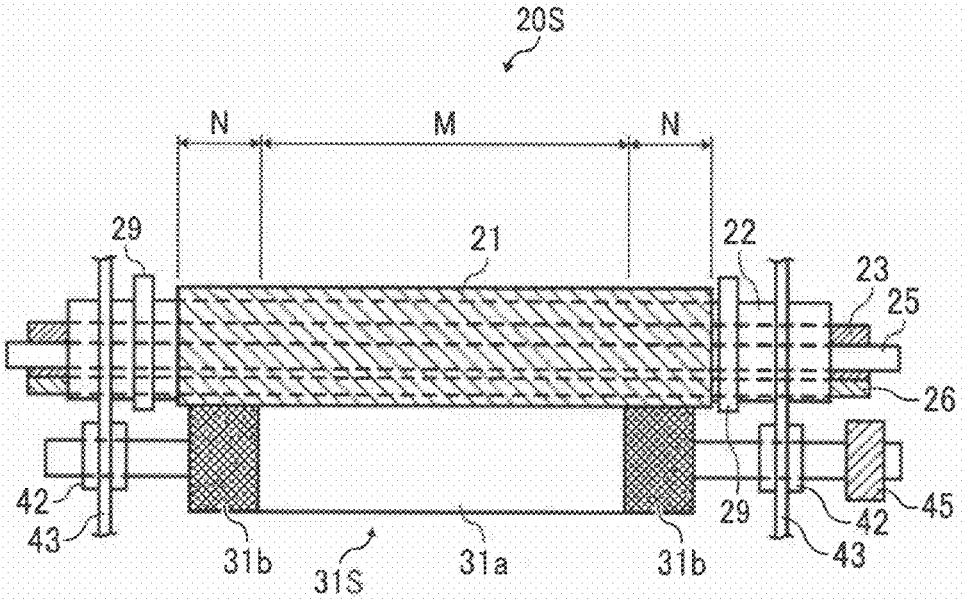
FIG. 7 is a plan view of a fixing device according to another exemplary embodiment of the present invention.

Referring to FIG. 7, the following describes a fixing device 20S according to another exemplary embodiment.

FIG. 7 is a plan view of the fixing device 20S. As illustrated in FIG. 7, the fixing device 20S includes a pressing roller 31S. The pressing roller 31S includes a low-thermal conductor 31*a* and high-thermal conductors 31*b*. The low-thermal conductor 31*a* and the high-thermal conductors 31*b* replace the cooling fan 61 and the duct 62 depicted in FIG. 3. The other elements of the fixing device 20S are equivalent to the elements of the fixing device 20 depicted in FIG. 3.

As in the fixing device 20 depicted in FIG. 3, the fixing device 20S includes the fixing belt 21, the stationary member 26, the metal member 22, the reinforcement member 23, the heat insulator 27, the heater 25, the pressing roller 31S serving as a rotary pressing member, the temperature sensor 40, and the stay 28 depicted in FIGS. 2 and 4. As in the fixing device 20 depicted in FIG. 5, the low-viscosity lubricant Q1 serving as a first lubricant is applied between the fixing belt 21 and the metal member 22 at the center portion of the fixing belt 21 in the width direction of the fixing belt 21, that is, the conveyance region M through which a recording medium P passes. The high-viscosity lubricant Q2 serving as a second lubricant is applied between the fixing belt 21 and the metal member 22 at the lateral edge portions of the fixing belt 21 in the width direction of the fixing belt 21, that is, the non-conveyance regions N through which the recording medium P does not pass.

Instead of the cooling fan 61 and the duct 62 depicted in FIG. 3, the high-thermal conductors 31*b* are provided in the non-conveyance regions N of the pressing roller 31S in such a manner that the high-thermal conductors 31*b* are integral with the pressing roller 31S, and serve as a cooling unit for cooling the non-conveyance regions N of the fixing belt 21. The low-thermal conductor 31*a* is provided in the conveyance region M of the pressing roller 31S. The high-thermal conductors 31*b* provide a higher thermal conductivity than the low-thermal conductor 31*a*.

The low-thermal conductor 31*a* may, for example, include a core metal, an elastic layer provided on the core metal, and a release layer provided on the elastic layer. The elastic layer includes silicon rubber having a thermal conductivity of about 0.15 W/m·K. The release layer includes PFA having a thermal conductivity of about 0.25 W/m·k.

By contrast, the high-thermal conductor 31*b* may include a core metal and an iron layer that is integrally provided on the core metal. The high-thermal conductor 31*b* has a thermal conductivity of about 85 W/m·k.

With the above-described structure, the conveyance region M of the fixing belt 21 is quickly heated by the metal member 22. By contrast, the non-conveyance regions N of the fixing belt 21 are cooled by the high-thermal conductors 31*b* that draw heat from the non-conveyance regions N of the fixing belt 21 as the fixing belt 21 is rotated by the rotating pressing roller 31S. In other words, the high-thermal conductors 31*b* of the pressing roller 31S serve as a cooling unit for cooling the non-conveyance regions N of the fixing belt 21. Accordingly, the high-thermal conductors 31*b* suppress temperature increase of the high-viscosity lubricant Q2 applied in the non-conveyance regions N. Consequently, volatilization of the high-viscosity lubricant Q2 is suppressed, and therefore the high-viscosity lubricant Q2 does not leak from the left end of the fixing belt 21 easily.

The fixing device 20S without the cooling fan 61 and the duct 62 provides effects equivalent to the effects provided by the fixing device 20 depicted in FIG. 3, downsizing the fixing device 20S and reducing manufacturing costs of the fixing device 20S. Further, air sent from the cooling fan 61 but leaked from the duct 62 does not disadvantageously cool the conveyance region M of the fixing belt 21.

As described above, in the fixing device 20S, the low-viscosity lubricant Q1 is applied between the fixing belt 21 and the metal member 22 in the conveyance region M corresponding to the center portion of the fixing belt 21 in the width direction of the fixing belt 21. The high-viscosity lubricant Q2 is applied between the fixing belt 21 and the metal member 22 in the non-conveyance regions N corresponding to the lateral edge portions of the fixing belt 21 in the width direction of the fixing belt 21. The high-thermal conductors 31*b* of the pressing roller 31S cool the non-conveyance regions N provided at the lateral edge portions of the fixing belt 21 in the width direction of the fixing belt 21. Accordingly, even when the fixing device 20S is driven at high speed with a shortened warm-up time or a shortened first print time, the fixing device 20S does not generate faulty fixing, does not increase sliding torque of the fixing belt 21 sliding over the metal member 22, and stably reduces wear of the fixing belt 21 and the metal member 22 generating over time due to sliding of the fixing belt 21 over the metal member 22.

Figure 8A:
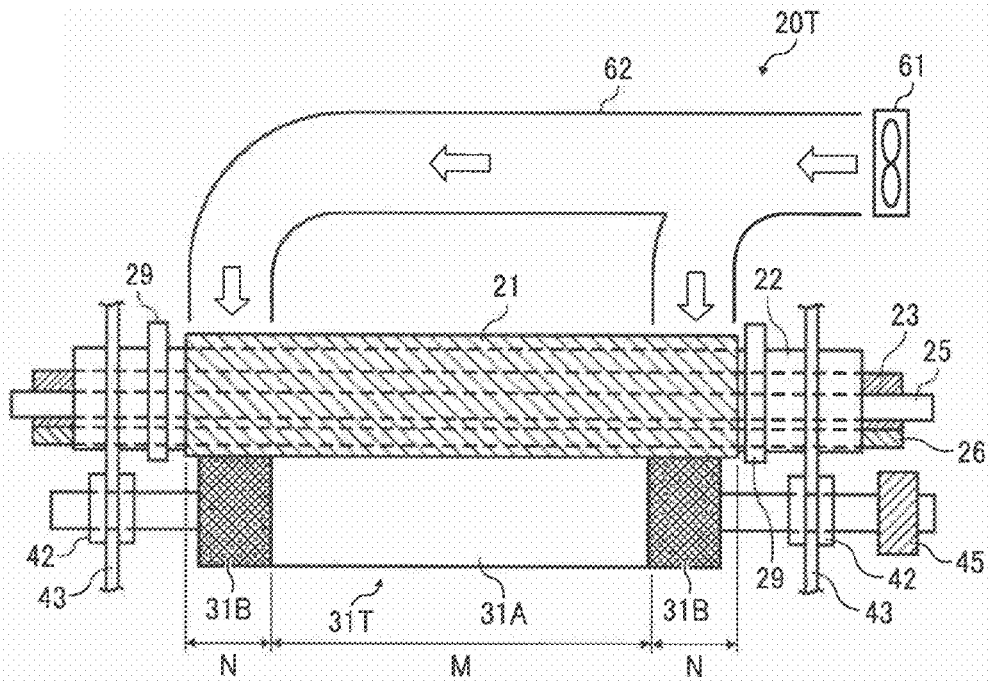
FIG. 8A is a plan view of a fixing device according to yet another exemplary embodiment of the present invention.
Figure 8B:
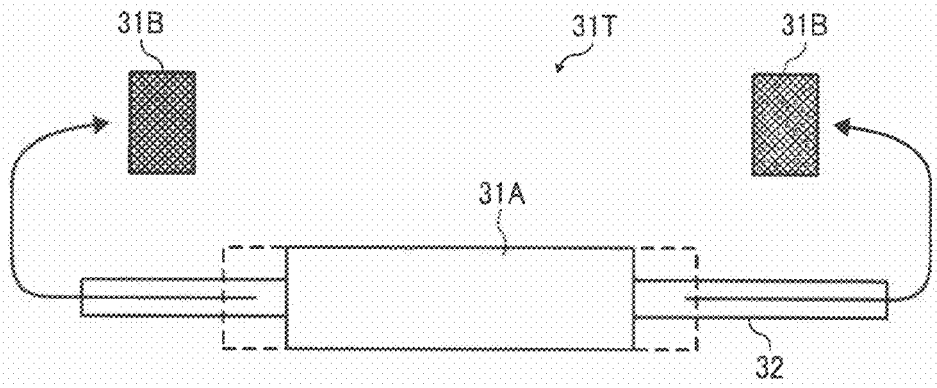
FIG. 8B is a plan view of a pressing roller included in the fixing device shown in FIG. 8A.

Referring to FIGS. 8A and 8B, the following describes a fixing device 20T according to yet another exemplary embodiment.

FIG. 8A is a plan view of the fixing device 20T. The fixing device 20T includes a pressing roller 31T. The pressing roller 31T includes a low-friction portion 31A and high-friction portions 31B. The pressing roller 31T replaces the pressing roller 31 depicted in FIG. 3. The other elements of the fixing device 20T are equivalent to the elements of the fixing device 20 depicted in FIG. 3. FIG. 8B is a plan view of the pressing roller 31T when the high-friction portions 31B are detached from the pressing roller 31T.

As in the fixing device 20 depicted in FIG. 3, the fixing device 20T includes the fixing belt 21, the stationary member 26, the metal member 22, the reinforcement member 23, the heat insulator 27, the heater 25, the pressing roller 31T serving as a rotary pressing member, the temperature sensor 40, and the stay 28 depicted in FIGS. 2 and 4. As in the fixing device 20 depicted in FIG. 5, the low-viscosity lubricant Q1 serving as a first lubricant is applied between the fixing belt 21 and the metal member 22 at the center portion of the fixing belt 21 in the width direction of the fixing belt 21, that is, in the conveyance region M through which a recording medium P bearing a toner image T passes. The high-viscosity lubricant Q2 serving as a second lubricant is applied between the fixing belt 21 and the metal member 22 at the lateral edge portions of the fixing belt 21 in the width direction of the fixing belt 21, that is, in the non-conveyance regions N through which the recording medium P bearing the toner image T does not pass.

The cooling fan 61, serving as a cooling unit, cools the non-conveyance regions N of the fixing belt 21. The low-friction portion 31A is provided at a center portion of the pressing roller 31T in a width direction of the pressing roller 31T parallel to an axial direction of the pressing roller 31T, that is, in the conveyance region M of the pressing roller 31T through which the recording medium P bearing the toner image T passes. The high-friction portions 31B are provided at lateral edge portions of the pressing roller 31T in the width direction of the pressing roller 31T, that is, in the non-conveyance regions N through which the recording medium P bearing the toner image T does not pass.

A sliding friction coefficient $\mu 2$ of a surface of the lateral edge portions of the pressing roller 31T in the width direction of the pressing roller 31T is greater than a sliding friction coefficient $\mu 1$ of a surface of the center portion of the pressing roller 31T in the width direction of the pressing roller 31T, that is, $\mu 2 > \mu 1$.

For example, the low-friction portion 31A of the pressing roller 31T provided in the conveyance region M through which the recording medium P passes may include a core metal, an elastic layer provided on the core metal, and a release layer provided on the elastic layer. The elastic layer includes silicon rubber. The release layer includes PFA. By contrast, each of the high-friction portions 31B provided in the non-conveyance regions N through which the recording medium P does not pass may include a core metal and an elastic layer provided on the core metal. The elastic layer includes silicon rubber. The sliding friction coefficient $\mu 2$ of silicon rubber is greater than the sliding friction coefficient μ1 of PFA. Accordingly, the sliding friction coefficient μ2 of the surface of the high-friction portion 31B, that is, the elastic layer formed of silicon rubber, is greater than the sliding friction coefficient μ1 of the surface of the low-friction portion 31A, that is, the release layer formed of PFA.

In other words, the low-friction portion 31A is provided in the conveyance region M of the pressing roller 31T, and the high-friction portions 31B are provided in the non-conveyance regions N of the pressing roller 31T, respectively. Silicon rubber of the elastic layer provided on the core metal in each of the non-conveyance regions N of the pressing roller 31T may have a high thermal conductivity to cool the non-conveyance regions N of the fixing belt 21 effectively so as to provide effects equivalent to the effects provided by the high-thermal conductors 31*b* of the fixing device 20S depicted in FIG. 7.

With the above-described structure, in spite of high rotation load applied to the fixing belt 21 in the non-conveyance regions N applied with the high-viscosity lubricant Q2, the fixing belt 21 does not slip on the metal member 22.

Specifically, the higher the temperature of the lubricant Q2, the greater the fluidity of the lubricant Q2. Accordingly, in the non-conveyance regions N cooled by the cooling fan 61, the fluidity of the lubricant Q2 is decreased, resulting in increased viscosity of the lubricant Q2. Consequently, driving torque or sliding torque of the lateral edge portions of the fixing belt 21 in the width direction of the fixing belt 21 is greater than driving torque or sliding torque of the center portion of the fixing belt 21 in the width direction of the fixing belt 21.

On the other hand, the stationary member 26 is pressed against the pressing roller 31T via the fixing belt 21, and the fixing belt 21 rotates in accordance with rotation of the pressing roller 31T due to friction resistance between the fixing belt 21 and the pressing roller 31T. Accordingly, the center portion of the fixing belt 21, which has smaller driving torque, is rotated by friction resistance between the fixing belt 21 and the pressing roller 31T. However, the lateral edge portions of the fixing belt 21 in the width direction of the fixing belt 21, which have greater driving torque, may slip over the pressing roller 31T. Consequently, a shearing force may be generated at a border between the center portion and the lateral edge portions of the fixing belt 21 in the width direction of the fixing belt 21. When the shearing force is applied to the fixing belt 21 repeatedly, the shearing force may break the fixing belt 21 over time.

To address this problem, in the fixing device 20T, the high-friction portions 31B provided in the non-conveyance regions N of the pressing roller 31T prevent slippage of the fixing belt 21 at a position at which the fixing belt 21 contacts the non-conveyance regions N of the pressing roller 31T. Thus, the fixing belt 21 rotates with uniform driving torque throughout the width direction of the fixing belt 21 to prevent the shearing force from being applied to the fixing belt 21 and breaking the fixing belt 21.

The high-friction portions 31B of the pressing roller 31T, which are provided at the lateral edge portions of the pressing roller 31T in the width direction of the pressing roller 31T and have a greater sliding friction coefficient, are detachably attached to the pressing roller 31T for replacement.

Specifically, as illustrated in FIG. 8B, the doughnut-shaped high-friction portions 31B are detachably attached to the metal core 32 of the pressing roller 31T. FIG. 8B illustrates the high-friction portions 31B in solid lines detached from the metal core 32 of the pressing roller 31T, and the high-friction portions 31B in broken lines attached to the metal core 32 of the pressing roller 31T.

High friction generated by the high-friction portions 31B disturbs smooth sliding of the recording medium P over the high-friction portions 31B at the nip NP and causes the recording medium P to generate paper dust. As a plurality of recording media P passes through the nip NP, paper dust may be adhered to the high-friction portions 31B, and therefore a surface of the high-friction portions 31B may become slippery, causing slippage of the fixing belt 21 over the pressing roller 31T. Accordingly, the shearing force may be applied to the fixing belt 21, breaking the fixing belt 21. Therefore, in the fixing device 20T, the high-friction portions 31B are detachably attached to the pressing roller 31T so that the high-friction portions 31B can be replaced with new ones periodically. In other words, only a part of the pressing roller 31T, that is, only the high-friction portions 31B, are replaced, not the entire pressing roller 31T, thus reducing maintenance costs.

As described above, in the fixing device 20T, the low-viscosity lubricant Q1 is applied between the fixing belt 21 and the metal member 22 in the conveyance region M corresponding to the center portion of the fixing belt 21 in the width direction of the fixing belt 21, as in the fixing device 20 depicted in FIG. 5. The high-viscosity lubricant Q2 is applied between the fixing belt 21 and the metal member 22 in the non-conveyance regions N corresponding to the lateral edge portions of the fixing belt 21 in the width direction of the fixing belt 21. The cooling fan 61 cools the non-conveyance regions N provided at the lateral edge portions of the fixing belt 21 in the width direction of the fixing belt 21. Accordingly, even when the fixing device 20T is driven at high speed with a shortened warm-up time or a shortened first print time, the fixing device 20T does not generate faulty fixing, does not increase sliding torque of the fixing belt 21 sliding over the metal member 22, and stably reduces wear of the fixing belt 21 and the metal member 22 generating over time due to sliding of the fixing belt 21 over the metal member 22.

Figure 9:
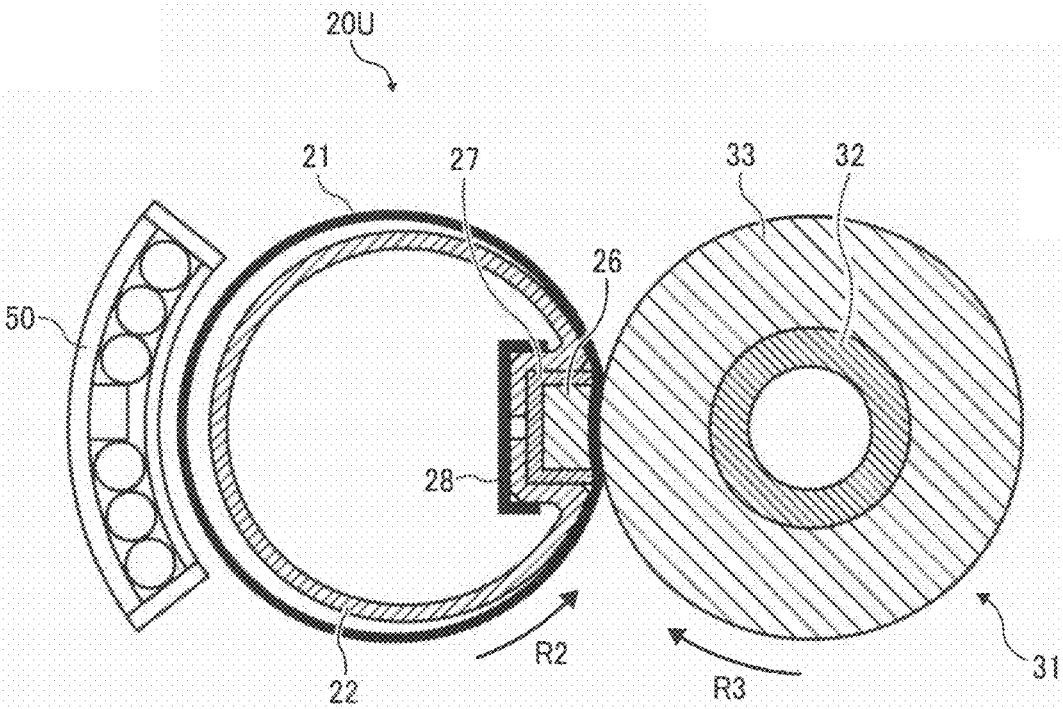
FIG. 9 is a sectional view of a fixing device according to yet another exemplary embodiment of the present invention.

Referring to FIG. 9, the following describes a fixing device 20U according to yet another exemplary embodiment. FIG. 9 is a sectional view of the fixing device 20U. The fixing device 20U includes an induction heater 50. The induction heater 50 replaces the heater 25 depicted in FIG. 2. The other elements of the fixing device 20U are equivalent to the elements of the fixing device 20 depicted in FIG. 2.

As in the fixing device 20 depicted in FIG. 2, the fixing device 20U includes the fixing belt 21, the stationary member 26, the metal member 22, the heat insulator 27, the pressing roller 31 serving as a rotary pressing member, the temperature sensor 40, and the stay 28. As in the fixing device 20 depicted in FIG. 5, the low-viscosity lubricant Q1 serving as a first lubricant is applied between the fixing belt 21 and the metal member 22 at the center portion of the fixing belt 21 in the width direction of the fixing belt 21, that is, in the conveyance region M through which a recording medium P passes. The high-viscosity lubricant Q2 serving as a second lubricant is applied between the fixing belt 21 and the metal member 22 at the lateral edge portions of the fixing belt 21 in the width direction of the fixing belt 21, that is, in the non-conveyance regions N through which the recording medium P does not pass.

The cooling fan 61, serving as a cooling unit, cools the non-conveyance regions N of the fixing belt 21.

The fixing device 20U includes the induction heater 50 serving as a heater instead of the heater 25 depicted in FIG. 2. In the fixing device 20 depicted in FIG. 2, radiation heat generated by the heater 25 heats the metal member 22. By contrast, in the fixing device 20U, the induction heater 50 heats the metal member 22 by electromagnetic induction.

The induction heater 50 includes an exciting coil, a core, and a coil guide. The exciting coil includes litz wires formed of bundled thin wires, which extend in the axial direction of the fixing belt 21 to cover a part of the fixing belt 21. The coil guide includes heat-resistant resin and holds the exciting coil and the core. The core is a semi-cylindrical member including ferromagnet having relative magnetic permeability in a range of from about 1,000 to about 3,000, such as ferrite. The core includes a center core and a side core to generate magnetic fluxes toward the metal member 22 effectively. The core is disposed opposite the exciting coil extending in the axial direction of the fixing belt 21.

The following describes operation of the fixing device 20U having the above-described structure. The induction heater 50 heats the fixing belt 21 rotating in the rotation direction R2 at a position at which the fixing belt 21 faces the induction heater 50. Specifically, a high-frequency alternating current is applied to the exciting coil to generate magnetic lines of force around the metal member 22 in such a manner that the magnetic lines of force are alternately switched back and forth. Accordingly, an eddy current generates on the surface of the metal member 22, and electric resistance of the metal member 22 generates Joule heat. The Joule heat heats the metal member 22 by electromagnetic induction, and the heated heating member 22 heats the fixing belt 21. In order to heat the metal member 22 effectively by electromagnetic induction, the induction heater 50 may face the metal member 22 in an entire circumferential direction of the metal member 22.

In the fixing device 20U, as in the above-described fixing device 20 depicted in FIG. 5, the low-viscosity lubricant Q1 is applied between the fixing belt 21 and the metal member 22 in the conveyance region M corresponding to the center portion of the fixing belt 21 in the width direction of the fixing belt 21. The high-viscosity lubricant Q2 is applied between the fixing belt 21 and the metal member 22 in the non-conveyance regions N corresponding to the lateral edge portions of the fixing belt 21 in the width direction of the fixing belt 21. The cooling fan 61 cools the non-conveyance regions N provided at the lateral edge portions of the fixing belt 21 in the width direction of the fixing belt 21. Accordingly, even when the fixing device 20U is driven at high speed with a shortened warm-up time or a shortened first print time, the fixing device 20U does not generate faulty fixing, does not increase sliding torque of the fixing belt 21 sliding over the metal member 22, and stably reduces wear of the fixing belt 21 and the metal member 22 generating over time due to sliding of the fixing belt 21 over the metal member 22.

Alternatively, the fixing device 20U may include the low-thermal conductor 31*a* and the high-thermal conductors 31*b* depicted in FIG. 7 or the low-friction portion 31A and the high-friction portions 31B depicted in FIG. 8A.

In the fixing device 20U, the induction heater 50 heats the metal member 22 by electromagnetic induction. Alternatively, a resistance heat generator may heat the metal member 22. For example, the resistance heat generator may contact an inner circumferential surface of the metal member 22 partially or wholly. The resistance heat generator may be a sheet-type heat generator such as a ceramic heater, and a power source may be connected to both ends of the resistance heat generator. When an electric current is applied to the resistance heat generator, electric resistance of the resistance heat generator increases a temperature of the resistance heat generator. Accordingly, the resistance heat generator heats the metal member 22 contacted by the resistance heat generator. Consequently, the heated metal member 22 heats the fixing belt 21.

As in the above-described exemplary embodiments, the low-viscosity lubricant Q1 and the high-viscosity lubricant Q2 may be applied between the fixing belt 21 and the metal member 22. The cooling fan 61 may cool the non-conveyance regions N of the fixing belt 21 applied with the high-viscosity lubricant Q2 to provide effects equivalent to the effects provided by the above-described exemplary embodiments.

As described above, in a fixing device (e.g., the fixing device 20, 20S, 20T, or 20U depicted in FIG. 3, 7, 8A, or 9, respectively), a low-viscosity lubricant (e.g., the lubricant Q1) is applied between a fixing belt (e.g., the fixing belt 21) and a metal member (e.g., the metal member 22) at a center portion of the fixing belt in an axial direction of the fixing belt. A high-viscosity lubricant (e.g., the lubricant Q2) is applied between the fixing belt and the metal member at lateral edge portions of the fixing belt in the axial direction of the fixing belt. A cooling unit (e.g., the cooling fan 61 depicted in FIG. 3 or 8A or the high-thermal conductors 31*b* depicted in FIG. 7) cools the non-conveyance regions N provided at the lateral edge portions of the fixing belt in the axial direction of the fixing belt. Accordingly, even when the fixing device is driven at high speed with a shortened warm-up time or a shortened first print time, the fixing device does not generate faulty fixing, does not increase sliding torque of the fixing belt sliding over the metal member, and stably reduces wear of the fixing belt and the metal member generating over time due to sliding of the fixing belt over the metal member.

In the above-described exemplary embodiments, the conveyance region M denotes a range corresponding to a width of the maximum recording medium available in the image forming apparatus 1 in a width direction of the recording medium perpendicular to the recording medium conveyance direction. The non-conveyance region N denotes a range other than the range defined by the conveyance region M.

Further, the width direction denotes a direction perpendicular to the recording medium conveyance direction.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

a flexible endless fixing belt rotating in a predetermined direction of rotation and comprising a center portion in an axial direction of the fixing belt that contacts the recording medium bearing the toner image and lateral edge portions in the axial direction of the fixing belt adjacent to the center portion that do not contact the recording medium bearing the toner image;

a metal member provided inside a loop formed by the fixing belt and facing an inner circumferential surface of the fixing belt to heat the fixing belt;

a rotary pressing member contacting an outer circumferential surface of the fixing belt to form a nip between the rotary pressing member and the fixing belt that nips and conveys the recording medium bearing the toner image;

a first lubricant applied between the metal member and the inner circumferential surface of the fixing belt at the center portion of the fixing belt; and a second lubricant having a viscosity greater than a viscosity of the first lubricant, applied between the metal member and the inner circumferential surface of the fixing belt at the lateral edge portions of the fixing belt.

2. The fixing device according to claim 1, wherein the rotary pressing member comprises:

a high-friction portion provided at lateral edge portions of the rotary pressing member in an axial direction of the rotary pressing member that contact the lateral edge portions of the fixing belt; and a low-friction portion having a sliding friction coefficient lower than a sliding friction coefficient of the high-friction portion, provided at a center portion of the rotary pressing member in the axial direction of the rotary pressing member that contacts the center portion of the fixing belt.

3. The fixing device according to claim 2, wherein the high-friction portion of the rotary pressing member is detachably attachable to the rotary pressing member.

4. The fixing device according to claim 1, further comprising a cooling unit provided outside the loop formed by the fixing belt to cool the lateral edge portions of the fixing belt.

5. The fixing device according to claim 4, wherein the cooling unit comprises a cooling fan that supplies air to the lateral edge portions of the fixing belt to cool the lateral edge portions of the fixing belt.

6. The fixing device according to claim 4, wherein the cooling unit comprises:

a high-thermal conductor provided at lateral edge portions of the rotary pressing member in an axial direction of the rotary pressing member that contact the lateral edge portions of the fixing belt; and a low-thermal conductor having a thermal conductivity smaller than a thermal conductivity of the high-thermal conductor, provided at a center portion of the rotary pressing member in the axial direction of the rotary pressing member that contacts the center portion of the fixing belt.

7. An image forming apparatus comprising the fixing device according to claim 1.

8. A fixing method for fixing a toner image on a recording medium, comprising the steps of:

rotating a flexible endless fixing belt in a predetermined direction of rotation;

transmitting heat from a metal member provided inside a loop formed by the fixing belt and facing an inner circumferential surface of the fixing belt to the fixing belt;

rotatively pressing a rotary pressing member against the fixing belt to form a nip between the rotary pressing member and the fixing belt that nips and conveys the recording medium bearing the toner image;

applying a first lubricant between the metal member and the inner circumferential surface of the fixing belt at a center portion of the fixing belt in an axial direction of the fixing belt over which the recording medium bearing the toner image passes; and applying a second lubricant, of which viscosity is greater than a viscosity of the first lubricant, between the metal member and the inner circumferential surface of the fixing belt at lateral edge portions of the fixing belt in the axial direction of the fixing belt over which the recording medium bearing the toner image does not pass.

9. The fixing method according to claim 8, further comprising the step of cooling the lateral edge portions of the fixing belt in the axial direction of the fixing belt over which the recording medium bearing the toner image does not pass.

* * * * *